US007060226B1

(12) United States Patent
Jessop et al.

(10) Patent No.: US 7,060,226 B1
(45) **Date of Patent: *Jun. 13, 2006**

(54) PIPETTE TIP PACKAGING AND TRANSFER SYSTEM

(75) Inventors: Paul M. Jessop, Salt Lake City, UT (US); Alma A. Timpson, Salt Lake City, UT (US); Tracy L. Jessop, Salt Lake City, UT (US)

(73) Assignee: Medax International, Inc., Salt Lake City, UT (US)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 09/196,524

(22) Filed: Nov. 20, 1998

Related U.S. Application Data

(60) Provisional application No. 60/066,773, filed on Nov. 24, 1997.

(51) Int. Cl.
*B01L 3/02* (2006.01)

(52) U.S. Cl. ..... 422/100; 422/99; 422/102; 422/104; 206/443; 206/446; 206/562; 206/563

(58) Field of Classification Search ..... 73/836.32; 422/100, 99, 102, 104; 206/443, 446, 562, 206/563, 821
See application file for complete search history.

(56) References Cited

U.S. PATENT DOCUMENTS 3,853,217 A 12/1974 Scordato et al.
4,346,057 A 8/1982 Bowser
4,349,109 A 9/1982 Scordato et al.
4,566,668 A * 1/1986 Koppenberg ..... 249/60
4,895,706 A 1/1990 Root et al.
4,948,564 A 8/1990 Root et al.
5,035,866 A 7/1991 Wannlund
5,057,282 A 10/1991 Linder
5,063,790 A * 11/1991 Freeman et al. ..... 73/864.14
5,098,663 A 3/1992 Berthold et al.
5,190,727 A * 3/1993 Hirsch ..... 422/67
5,324,482 A * 6/1994 Scaramella et al. ..... 422/100
5,335,481 A * 8/1994 Ward ..... 53/446
5,576,214 A * 11/1996 Shaw ..... 436/43
5,827,745 A * 10/1998 Astle ..... 436/54

* cited by examiner

*Primary Examiner*—Jill Warden
*Assistant Examiner*—Dwayne K Handy
(74) *Attorney, Agent, or Firm*—Holme Roberts & Owen LLC

(57) ABSTRACT

The pipette tip packaging and transfer system comprises a plurality of receiving plates and a transfer member. Each receiving plate includes a plurality of openings for receiving pipette tips in a substantially vertical alignment at a medial position thereof. The loaded receiving plates can be stacked one atop of another with the pipette tips contained within a first receiving plate being received in the top openings of the aligned pipette tips contained within the underlying receiving plate of the stack. The transfer member has a plurality of projections extending from the bottom surface of the transfer member at positions that correspond to the location of the openings of the receiving plate. The projections are configured and arranged to extend into the top openings of the pipette tips on the upper-most receiving plate and maintain the pipette tips in a fixed and substantially perpendicular alignment in relation to the transfer member and receiving plate. The pipette tip packaging and transfer system can further include a container or box which is sized to receive and securely hold the pipette tip packaging and transfer assembly.

14 Claims, 5 Drawing Sheets

PIPETTE TIP PACKAGING AND TRANSFER SYSTEM

PRIORITY CLAIM

Under the provisions of 35 U.S.C. § 1.119(e), priority is claimed from Provisional Patent Application 60/066,773 filed Nov. 24, 1997.

BACKGROUND OF THE INVENTION

1. Field of Invention

The present invention relates generally to a packaging and transfer system for disposable pipette tips. In particular, the present invention relates to an improve packaging and transfer system for pipette tips.

2. State of the Art

Medical and research laboratories are called upon to perform large numbers of repetitive tests. For example, large quantities of routine blood tests may be performed by a laboratory technician at one time. Samples of the blood in test tubes may be arranged in an array to facilitate speed in performance of the tests. For example, the test tubes may be arranged on a rack eight tubes wide by twelve tubes deep. Specific chemical or biological materials are then added to each tube in like amounts as a part of the testing process. This is typically accomplished by drawing in and subsequently injecting the chemical or biological material through a pipette tip that is attached to a pipette tool.

For testing of arrays of test tubes, multi-site pipette tools are provided that can hold multiple pipette tips. That is, manufactures of pipette tips provide them on trays or racks in an array (see U.S. Pat. No. 3,853,217 (Scordato); U.S. Pat. No. 5,324,482 (Scaramella, et al)) so that a multi-site pipette tool may easily register with sets of pipette tips. The pipette tips are typically thrown away after use.

The disposable pipette tips are typically supplied in trays which have openings for receiving 96 pipette tips. Typically, each of these trays is packaged in an outer box; and both the box and trays are discarded once the tips have been used. These trays take up a substantial amounts of space and utilize a large amount of packaging material which must be discarded. To eliminate this problem, empty trays are sometimes refilled by hand with a new set of pipette tips. However, due to the tedious and time-consuming nature of this process, empty trays are most often discarded, which further increases waste materials particularly with an increasing volume of testing.

U.S. Pat. No. 5,324,482 (Scaramella, et al.) shows a system for storing pipette tips. It uses an alignment plate that is attached to a transfer card by a locking mechanism. The pipette tips are stored on the transfer card; and a stack of transfer cards with pipette tips are positioned in a box for transport and sale along with an alignment plate. Although reducing the number of empty trays and other disposable material, the locking mechanism is hard to operate and costly.

Thus, the laboratories and other testing facilities have a need for an inexpensive pipette tip packaging, storage, and transfer system that permits storage of pipette tips within a container of compact size in order to reduce the amount of storage space needed to stock the pipette tips and to further reduce the amount of packaging material used and thrown away. Furthermore, a need exists for a pipette tip storage and transfer system that is easy simple and easy to use to facilitate transfer of pipette tips from a storage container to a holding tray without requiring latching mechanisms or other moving parts.

BRIEF SUMMARY OF THE INVENTION

The present invention relates to a new and improved pipette tip packaging and transfer system which takes up a small amount of space so as to limit or minimize the amount of packaging materials and waste produced in comparison to many other systems that provide a similar number of pipette tips. The system utilizes a minimal number of moving and interacting parts, which makes it easy to use and inexpensive to manufacture in relation to other similar storage and transfer systems known in the art. The pipette tip packaging and transfer system comprises a plurality of receiving plates, each plate having a plurality of openings for receiving pipette tips in a substantially vertical alignment at a medial position thereof. The loaded receiving plates can be stacked one atop of another with the pipette tips contained within a first receiving plate being received in the top openings of the aligned pipette tips contained within the underlying receiving plate of the stack. A container is provided to securely hold the stack of receiving plates.

In a preferred embodiment of the invention, a transfer member or plate having comparable dimensions to those of the receiving plate is provided. A plurality of projections extend from the bottom surface of the transfer member at positions that correspond to the location of the openings of the receiving plate. The projections are configured and arranged to extend into the top openings of the pipette tips on the upper-most receiving plate and maintain the pipette tips in a fixed and substantially perpendicular alignment in relation to the transfer member and receiving plate. The pipette tip packaging and transfer system can further include a container or box which is sized to receive and securely hold the receiving plate, the transfer member, and the pipette tips contained within the receiving plate and the transfer member, and also includes a lid sized to fit over the container or box. The container includes front, back, and side walls, all or some of which include cut outs thereon that enable a user to grab and lift each receiving plate, from the stack of receiving plates located within the container, with the transfer member.

With the pipette tip packaging and transfer system of the present invention, an empty pipette tip holding tray can be quickly and easily refilled. To do so, the user simply grasps the upper-most receiving plate and the transfer member with his/her index finger and thumb and lifts the same out of the container or box. The pipette tips are then inserted into the pipette tip holding tray by aligning distal ends of the pipette tips located within the receiving plate with the openings in the pipette tip holding tray and lowering the receiving plate and attached transfer member into the pipette tip holding tray until the pipette tips are engaged in the tray openings. The transfer member is then lifted away from the pipette tip openings, leaving the receiving plate resting on the holding tray and the pipette tips resting within the tray openings. The transfer member is then placed over the next uppermost receiving plate in the stack within the container, making sure to insert the protrusions extending from the bottom surface of the transfer plate into the openings of the pipette tips located within the uppermost receiving plate. This final step prepares the pipette tip packaging and transfer system for the next transfer and refill procedure.

Alternatively, the pipette tips located within the upper most receiving plate in the container may be directly dispensed from the upper most receiving plate in the stack of the container or box. Thus, the need to transfer of the pipette tips into a pipette holding tray is eliminated.

BRIEF DESCRIPTION OF THE DRAWINGS

While the specification concludes with claims particularly pointing out and distinctively claiming that which has been regarded as the present invention, the advantages of this invention can be more readily ascertained from the following description of the invention when read in conjunction with the accompanying drawings in which:

DESCRIPTION OF THE PREFERRED EMBODIMENT

Figure 1:
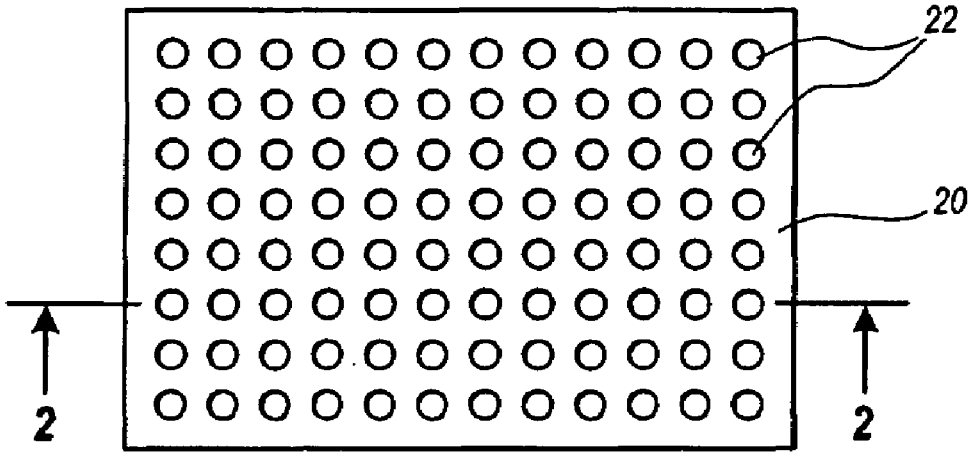
FIG. 1 is a top plan view of a receiving plate which forms part of the pipette tip packaging and transferring system according to a preferred embodiment of the invention.
Figure 2:
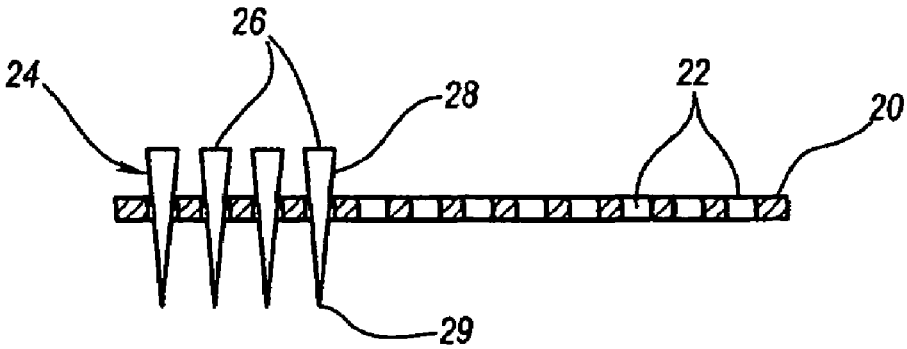
FIG. 2 is a cross-sectional view taken along line 2—2 of FIG. 1, illustrating the receiving plate with several pipette tips positioned within the holes of the receiving plate.

Referring to FIGS. 1 and 2, a receiving plate 20 is shown, which either alone or in combination with other such receiving plates form a preferred embodiment of a pipette tip packaging and transfer system of the present invention. Each receiving plate 20 has a substantially rectangular shape and includes a rectangular array of ninety-six (96) openings 22 for receiving pipette tips 26, as further illustrated in FIG. 2. Although the preferred embodiment includes a rectangular array with ninety-six (96) openings 22, it is understood that receiving plate 20 can include any number of openings 22 located at any suitable configuration which matches the configuration of corresponding openings located on a pipette tip holding tray, as described below in conjunction with FIGS. 9 and 10. Each opening 22 is sized and shaped to permit a distal portion of each pipette tip to be inserted vertically through openings 22 and held in position at a proximal portion 28 of pipette tips 24. Thus, the outer periphery of openings 22 are less than the pipette tip diameter at proximal portion 28 of each pipette tip 24.

Figure 9:
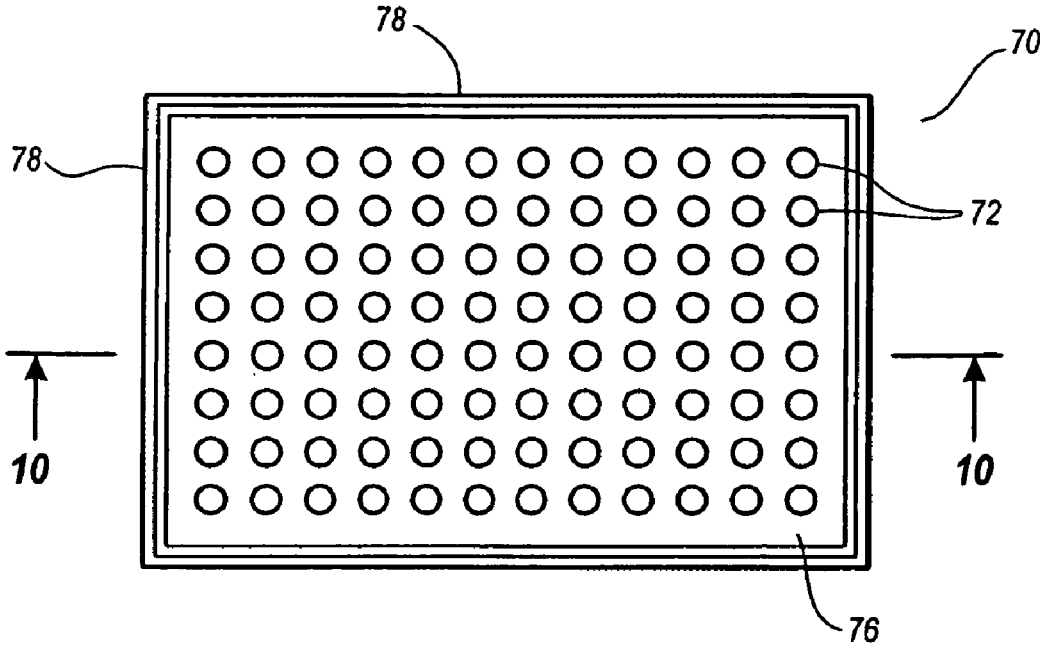
FIG. 9 is a top plan view of a pipette tip holding tray for dispensing pipette tip.
Figure 10:
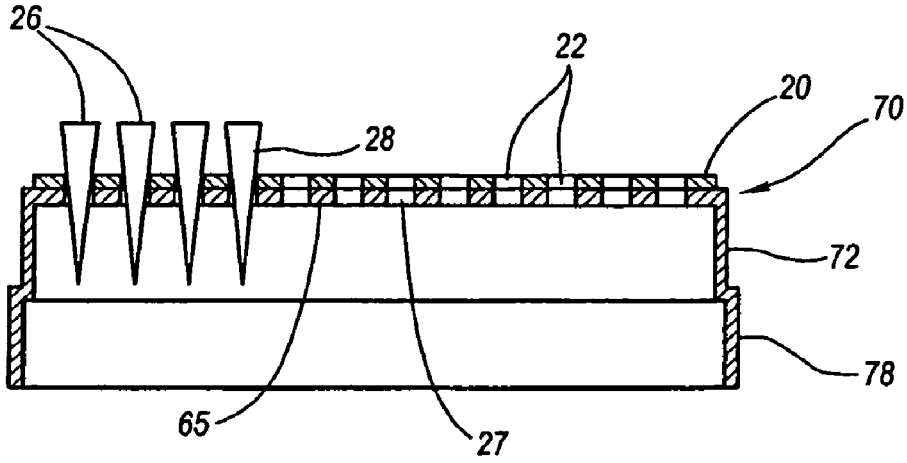
FIG. 10 is a cross-sectional view taken along line 10—10 of FIG. 9.

FIGS. 9 and 10, show a holder tray 78 which is typically configured to hold 96 pipette tips. When ten such systems (i.e., 960 pipette tips) are needed, ten complete pipette tip holding trays must be stacked one on top of another. There is a significant amount of dead space that results. Further, upon use of the pipette tips, the trays such as tray 78 are excess and thrown away.

In the present system, the holding tray 70 is reused as often as desired to act as a rack into which pipette tips are placed using a receiving plate 20. The plate 20 with pipette tips is transferred to the holding tray 70 using the transfer tool as hereinafter discussed. In use, a plurality of receiving plates 20 may be stacked one on top of another by aligning a distal end 29 of each pipette tip 24 with the underlying and corresponding pipette tip opening 26 located at a proximal end 28 of pipette tip 24. In this manner, a plurality of the pipette tips 24 may be stacked and stored in a minimal amount of space until needed. Upon transfer the holding tray 70, the pipette tips can be accessed using a multi-site pipette tool. When all the pipette tips are used all that remains is the initial box and the receiving plates 20.

Figure 3:
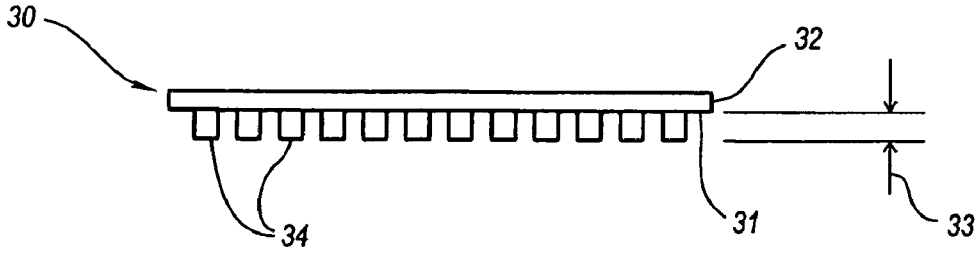
FIG. 3 is a cross-sectional view of a transfer member of the pipette tip packaging and transfer system according to a preferred embodiment of the invention.

Referring to FIG. 3, a transfer member 30 that comprises a second portion of the pipette tip packaging and transfer system of the present invention is shown. Transfer member 30 comprises a flat rectangular plate 32 having dimensions that substantially match those of receiving plate 20. A plurality of projections or bosses 34 are attached to a bottom surface 31 of rectangular plate 32 to extend away therefrom a distance 33 selected to facilitate connection and stable alignment of the pipette tips 24. The bosses 34 are dimensioned and arranged to match openings 22 of receiving plate 20 and openings 72 located in a conventional pipette tip holding tray 70 described below in conjunction with FIGS. 9 and 10. That is, a boss 34 is provided to register with each pipette tip in the illustrated embodiment. In some applications, it may be available to have a transfer member 30 with bosses 34 around the outer periphery 37 of the rectangular plate 32. That is portions of the array of bosses 34 toward the center of the transfer member 30 may be eliminated to save cost in materials and in tooling. The bosses 34 and the openings 22 are in axial alignment 35 when the transfer member 30 is positioned to align the bosses 34 with the proximal ends 28 of the pipette tips 24.

As further detailed below in relation to FIGS. 5 and 6, projections or bosses 34 are designed to snugly fit and engage in the top opening 26 of each pipette tip 24 supported or positioned in receiving plate 20. The bosses 34 function to maintain the pipette tips 24 in a substantially vertical orientation within receiving plate 20 so that the pipette tips may be easily placed into the holding tray 70.

Figure 4:
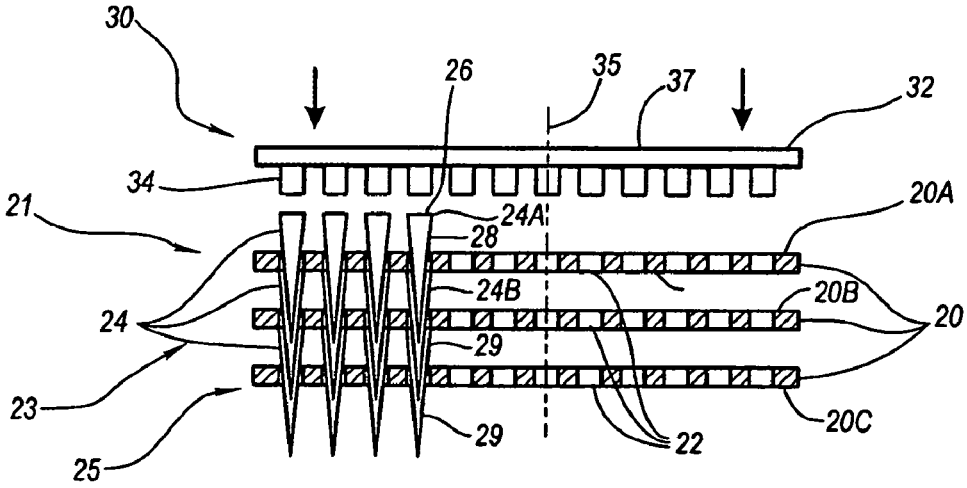
FIG. 4 is a cross-sectional view of the receiving plate, transfer member, and pipette tips located there between, forming the main parts of a preferred pipette tip packaging and transfer system according to the present invention.

FIG. 4 illustrates a storage and transfer portion of the pipette tip packaging and transfer system of the present invention, including receiving plate 20 and transfer member 30. As shown, pipette tips 24 can be stacked vertically atop of one another by introducing pipette tips 24 into receiving plate 20 and aligning the distal tip 29 of each pipette tip 24 over and into top openings 26 of pipette tips 24 located in an underlying receiving plate 20. A first assembly 21 consisting of the uppermost receiving plate 20A and pipette tips 24A is formed. Receiving plates 20B and 20C are each formed into assemblies 23 and 25 respectively by placing pipette tips 24A into pipette tips 20B. The assemblies 21, 23 and 25 are then all stacked as shown. When stacked, the bottom surface 27 of receiving plate 20A rests on the shoulder 29 (FIG. 4) above the annular portions 39 of proximal portion 28 which are formed to have top opening 26. In this fashion, multiple stacks of pipette tips 24 contained within receiving plate 20 can be stacked vertically to form a compact assembly of pipette tips 24 when those holding trays are stacked atop of one another. Stabilization of the pipette tips 24 during the alignment and stacking process is accomplished by first lowering transfer member 30 onto the proximal end 28 of each pipette tip 24, such that all projections or bosses 34 on transfer member 30 are inserted into top openings 26 of pipette tips 24.

Figure 5:
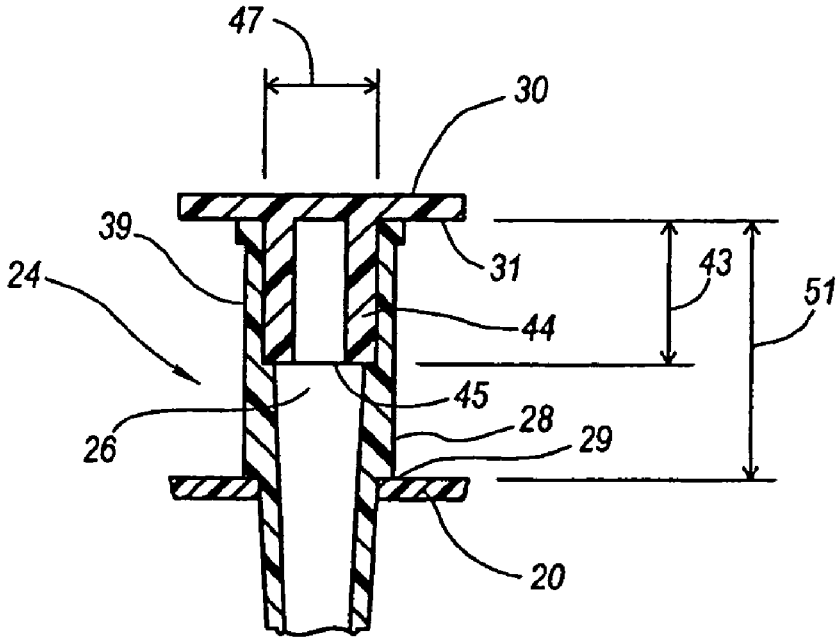
FIG. 5 is an enlarged sectional view of the receiving plate, a pipette tip, and a first embodiment of a transfer member according to the present invention.
Figure 6:
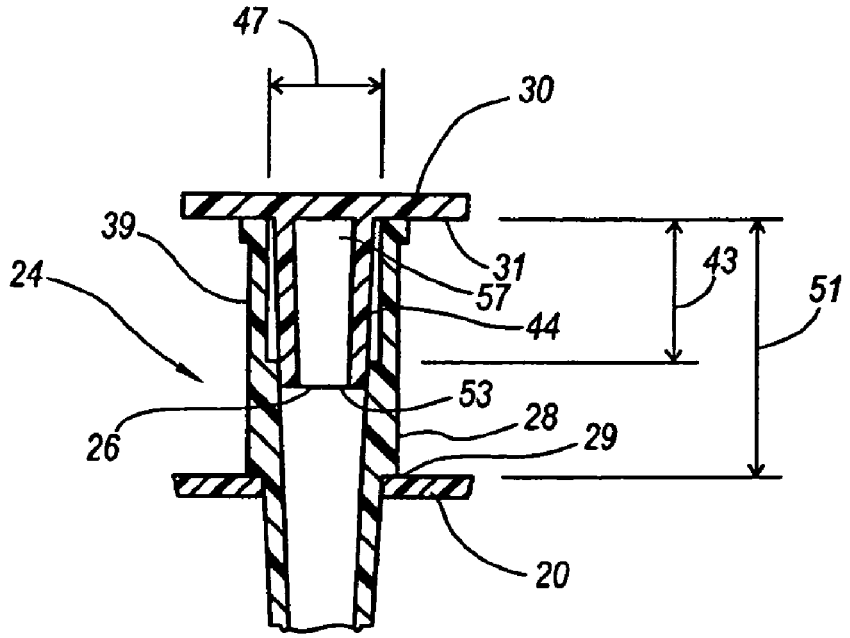
FIG. 6 is an enlarged sectional view of the receiving plate, a pipette tip, and a second embodiment of the transfer member of the present invention.

FIGS. 5 and 6 illustrate two preferred embodiments of the transfer member projections engaged to a pipette tip on a receiving plate. In FIG. 5, a projection or boss 44 having a substantially uniform cross-section or diameter throughout its length 43 is illustrated. Even though the boss is shown to be essentially cylindrical in form, it should be understood that projection or boss 44 may be of a variety of suitable lengths, widths, diameters and shapes. Indeed, the bosses may even be tapered from the surface 31 toward the distal end 45 so that entry of the bosses 44 into the openings 26 is facilitated and will yield a snug fit along its length 43. That is, the bosses 44 are shaped to snugly register in the aperture 26 so that the diameter 47 of projections or bosses 44 is preferably equal to or slightly less than the diameter of the aperture 26.

Projection or bosses 44 is preferably sized in length to hold pipette tip 24 in a substantially immobile position generally normal to the undersurface 31. In other words, projection or bosses 44 maintains pipette tip 24 in a substantially perpendicular alignment in relation to transfer member 30. In practice it has been found that the bosses 44 is sized in length 43 to extend into the aperture 26 at least half the depth 51 of the aperture 26 or the length of the upper portion 28 of the pipette tip 24. Lengths 43 from about half to the entire depth 51 of the aperture 26 are acceptable.

FIG. 6 illustrates a second preferred embodiment of transfer member 30 that has a tapered projection or bosses 46 which tapers from the undersurface 31 to its distal end 53. The narrowing configuration of tapered projection 46 permits positioning of projection 46 further or deeper into lumen 48 of the aperture 26 of pipette tip 24 to provide greater stability of pipette tip 24 relative to transfer member 30. Advantageously, tapered projection 46 may be sized and shaped so as to permit contact between the distal end 53 of projection 46 and the inner wall 55 defining lumen 48, and to provide further contact between an uppermost portion of projection 46 and the mouth 57 of the opening 26. Although numerous sizes and configurations are envisioned, tapered projection 46 preferably has a length 59 in excess of half the distance 51 of the upper portion 28 to substantially immobilize and hold pipette tip 24 in a substantially perpendicular alignment with respect to the surface 31 of transfer member 30. Additionally, the surface 61 of tapered projection 46 is preferably sized and shaped to engage a maximum possible surface area of the inner wall 55 defining lumens 48 and 50 of pipette tip 24.

Figure 7:
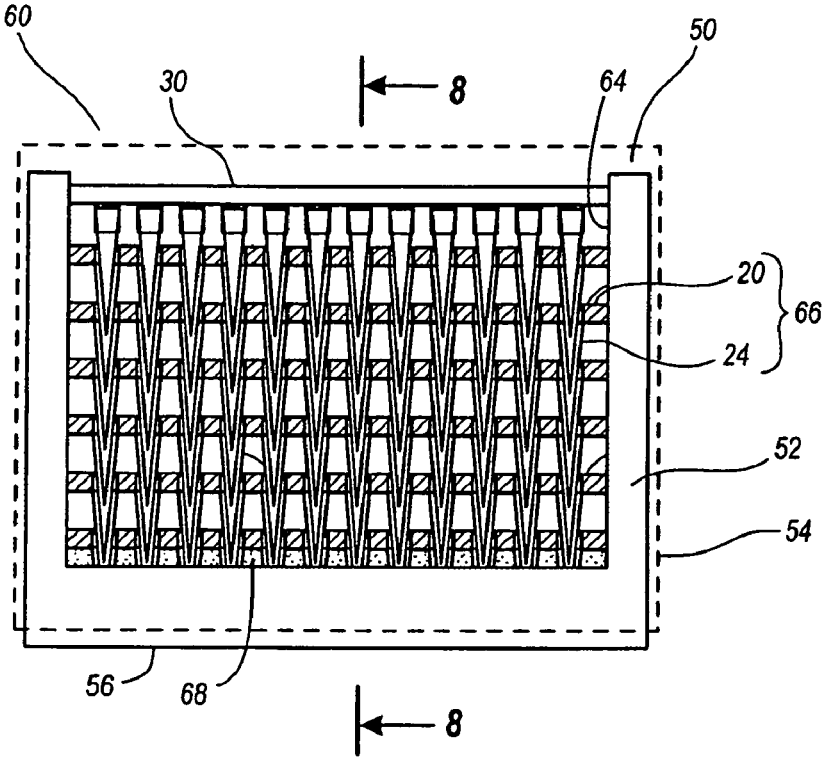
FIG. 7 is a side elevational view of a container and lid forming a part of the packaging and transfer system.
Figure 8:
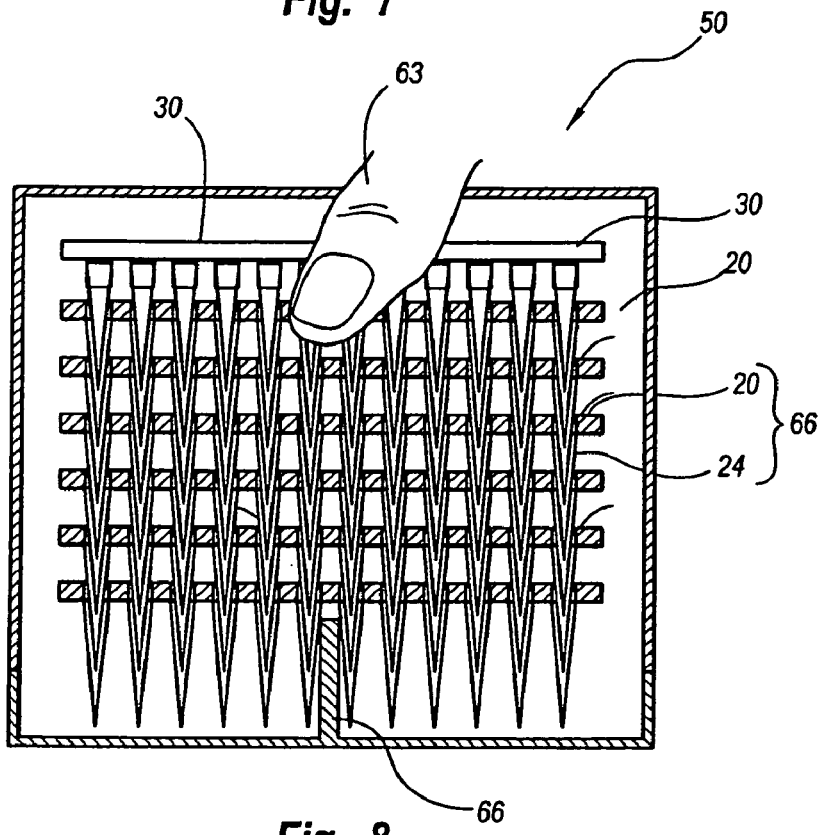
FIG. 8 is a cross-sectional view taken along line 8—8 of FIG. 7.

FIGS. 7 and 8 illustrate a complete pipette tip packaging and transfer system, including all of the parts previously illustrated in FIGS. 1–4. As illustrated in FIG. 7, a container 50 is provided for storing a stack 66 of receiving plates 24 and pipette tips 20. Container 50 includes a rectangular base 56, side walls 52, and end walls 54. Container 50 is configured to receive stack 66 in a snugly-sliding fit. Each of side walls 52 include a cut out portion 64 that provides access for grasping and lifting each receiving plate 20 and transfer member 30. A support member 68 is attached to and extends along the center of base 56 for elevating the lowermost receiving plate 20 of stack 66 such that the distal end 29 of pipette tips 24 contained therein are sufficiently raised so as to prevent contact of pipette tips 24 with the inner surface of base 56, as illustrated in FIGS. 7 and 8.

To operate the pipette tip packaging and transfer system of the present invention, transfer member 30 is urged toward the uppermost receiving plate 20 of stack 66 by aligning projections 34 and engaging the same in the top opening 26 of each pipette tip 24 contained in the uppermost receiving plate 20. The operator then grasps the opposing sides of both member 30, typically using a thumb 63 (shown in phantom in FIG. 8) and index finger, and lifts the uppermost receiving plate 20 and transfer member 30 from container 50. With receiving plate 20 and transfer member 30 firmly grasped by the user between thumb and forefinger, the distal ends 29 of pipette tips 24 are aligned with openings 72 located in an upper wall 76 of pipette holding tray 70 (FIGS. 9 and 10) and lowered onto upper wall 76 so that distal ends 29 of pipette tips 24 extend through opening 72 and so that the lower surface 27 of receiving plate 20 lies on upper wall 65 of holding tray 70, as illustrated in FIG. 10. The user then releases the sides of receiving plate 20 and lifts transfer member 30 upwardly away from holding tray 70, thus removing each projection 34 of transfer member 30 from top opening 26 of each pipette tip 24, leaving pipette tips 24 ready for use in holding tray 70. When all the pipette tips 24 are used, the receiving plate 20 may be removed and discarded or recycled.

When all the pipette tips on the holding tray 70 are used, transfer member 30 is then once again lowered onto the pipette tips 24 of the next uppermost receiving plate 20 by aligning projections 34 of transfer member 30 with top opening 26 of each pipette tip 24. In this fashion, holding tray 70 can be refilled with pipette tips 24 repeatedly in a simple and quick manner.

What is claimed is:

1. A method for transferring a plurality of pipette tips from a container to a holding tray, comprising the steps of:

providing a container for holding a plurality of receiving plates in a stack, each of said receiving plates being configured to hold a plurality of pipette tips in an array;

providing a stack of receiving plates unconnected to and unconnectable to a transfer member, each receiving plate consisting of a plurality of apertures formed therein each sized to receive a pipette tip therethrough, each receiving plate having a plurality of pipette tips each disposed in one of said plurality of apertures, each of said pipette tips having a first end and a second end spaced from said first end, said first end having an opening extending into said pipette tip, said stack of receiving plates including a first receiving plate with a first plurality of pipette tips disposed in a first pattern thereon and a second receiving plate with a second plurality of pipette tips disposed in a second pattern thereon, said second pattern being arranged to position said second end of said pipette tips in said second pattern to nest into the openings of said first plurality of pipette tips, positioning said stack of receiving plates with pipette tips into said container;

providing said transfer member that is shaped to fit within said container, said transfer member configured to not be connectable to any receiving plate of said stack of receiving plates, said transfer member having an upper surface and a lower surface and a plurality of projections arranged in said first pattern, each projection of said plurality of projections extending from said lower surface a preselected distance to effect stable engagement with a corresponding first end of a pipette tip when said projection is received into said first opening of said pipette tip;

providing a holding tray positioned on a support surface, said holding tray having an upper wall spaced from said support surface and a plurality of apertures extending through said upper wall and arranged in said first pattern;

grasping said transfer member with the thumb and forefinger of a user and positioning said transfer member over said container;

aligning the projections of said transfer member with the openings of said second plurality of pipette tips;

lowering said transfer member into said container until said projections extend into and engage with said second plurality of pipette tips;

grasping both said transfer member and said second receiving plate with the thumb and a finger of said user and holding them together while removing said transfer member and said second receiving plate with said second plurality of pipette tips from said container;

positioning said transfer member, said second receiving plate and said second plurality of pipette tips over said holding tray;

aligning said second plurality of pipette tips with said plurality of apertures of said holding tray;

lowering said transfer member, said second receiving plate and said second plurality of pipette tips toward said holding tray until said second plurality of pipette tips has been inserted into and engaged with corresponding apertures of said holding tray;

releasing said thumb and forefinger from said transfer member and said second receiving plate; and removing said transfer member from said second plurality of pipette tips.

2. The method of claim 1, wherein said transfer member and said second receiving plate are grasped with and between the thumb and a finger other than the forefinger of said user and are held together thereby with the first knuckle of the forefinger being urged against the upper surface of said transfer member while removing said transfer member and said second receiving plate with said second plurality of pipette tips from said container.

3. The method of claim 1, wherein said container has a rectangular cross section defined by said length and width and wherein said first receiving plate has a rectangular shape with dimensions substantially equal to said length and width.

4. The method of claim 1, wherein said stack of receiving plates and pipette tips has a third receiving plate unconnected to and unconnectable to said transfer member with a plurality of apertures formed therein sized to receive pipette tips therethrough, said third receiving plate being positioned over said second plurality of pipette tips, said third receiving plate having a third plurality of pipette tips in a third pattern extending through the apertures of said third receiving plate and into the first ends of said second plurality of pipette tips, and wherein said transfer member is registerable with the first ends of pipette tips of said third plurality of pipette tips to transfer said third plurality of pipette tips and said third receiving plate from said container to said holding tray prior to transferring said second plurality of pipette tips and said second receiving plate from said container to said holding tray.

5. The method of claim 4, wherein said stack of receiving plates and pipette tips comprises "n" layers of receiving plates and pluralities of pipette tips, and wherein each one of said "n" layers is transferred from said container to said holding tray in a sequential manner, transferring the "$i^{th}$" layer prior to transferring the "$i\text{-}1^{th}$" layer.

6. The method of claim 1 wherein said first array and said second array contain the same number of pipette tips.

7. A system for positioning pipette tips into a dispensing tray which has a matrix of tray apertures sized to receive pipette tips therein, said system comprising:

a plurality of pipette tips each having a length;

a receiving card unconnected to and configured to not be attachable to any structure configured for engaging and maintaining said pipette tips in a stable position relative to said receiving card, said receiving card consisting of a matrix of card apertures formed therein each sized for positioning one of said pipette tips there through to further register with an aperture of a matrix of tray apertures of a dispensing tray, said receiving card having an upper surface spaced from a lower surface, said card apertures each being shaped and sized to receive a pipette tip to hold said pipette tip with a portion extending a spacing distance away from said upper surface of said receiving card, said receiving card having a length and a width and said receiving card having two opposite card edges extending along said length of said receiving card in substantial alignment; and a transfer member for engaging and maintaining said pipette tips in a stable position relative to said receiving card, said transfer member being configured with no structure for attaching said transfer member to said receiving card, said transfer member being a plate with an upper surface and with an undersurface, said undersurface having a plurality of projections extending from said undersurface, each of which projections being positioned and sized to extend away from said undersurface a distance selected so that upon registry of said projection with said first end of said pipette tips, said projections engaging said pipette tips to inhibit lateral movement of said transfer member relative to said pipette tips positioned in said matrix of card apertures, said preselected distance between the tip of the finger and the first knuckle back from the tip of said finger, said plate having a length and a width selected comparable to the length and width of said receiving card and said plate having two opposite plate edges extending along said length of said plate in substantial alignment with each other for positioning relative to said card edges, said spacing distance being elected to position said receiving card and said plate and in turn said card edges and said plate edges relative to each other at said spacing distance for simultaneous engagement by the thumb and a finger of one hand of a user to retain said receiving card and said plate in alignment and relative to each other while transferring said receiving card with said pipette tips from a first location to alignment with and positioning in said matrix of tray apertures of said dispensing tray.

8. The system of claim 7 wherein said receiving card and said plate have substantially the same length and width.

9. The system of claim 7 wherein said spacing distance is less than the distance from the first joint of the user's thumb to the tip of the user's thumb.

10. The system of claim 8 wherein said receiving card and said plate are substantially rectangular in shape.

11. The system of claim 10 wherein said projections extend into said pipette tips a distance from about one fourth of said spacing distance to about one half of said spacing distance.

12. A system for positioning pipette tips into a dispensing tray which has a matrix of apertures sized to receive pipette tips therein with said pipette tips having a length, said system consisting essentially of:

a plurality of pipette tips each having length;

a receiving card consisting of a matrix of card apertures formed therein, said matrix of card apertures being substantially uniformly sized for positioning pipette tips there through to register with each aperture of a matrix of tray apertures of a dispensing tray, each aperture of said matrix of tray apertures being sized to receive a pipette tip therein, said receiving card having an upper surface spaced from a lower surface, said card apertures each being shaped and sized to receive a pipette tip to hold said pipette tip with receiving card having a length and a width and said receiving card having two opposite card edges extending along said length of said receiving card in substantial alignment; and a transfer member for engaging and maintaining said pipette tips in a stable position relative to said receiving card, said transfer member being without structure for connecting said transfer member to said receiving card, said transfer member having an upper surface and an undersurface with a plurality of projections extending from said undersurface, each of which projections is positioned and sized to extend into one of said pipette tips a preselected distance to stably engage said pipette tips positioned in said matrix of card apertures, said transfer member having a length and a width selected comparable to the length and width of said receiving card and said plate having two opposite, member edges extending along said length of said transfer member in substantial alignment with each other for positioning relative to the card edges, said spacing distance being selected to position said receiving card and said transfer member and in turn said card edges and said member edges relative to each other for simultaneous engagement by the thumb and a finger of one hand of a user to retain the receiving card and the transfer member in alignment while transferring said receiving card with said pipette tips from a first location to alignment with and positioning in said matrix of tray apertures of said dispensing tray.

13. A system for positioning pipette tips into a dispensing tray which has a matrix of tray apertures sized to receive pipette tips therein, said system comprising:

a plurality of pipette tips each having a length;

a receiving card unconnected to and configured to not be attachable to any structure configured for engaging and maintaining said pipette tips in a stable position relative to said receiving card, said receiving card consisting essentially of a matrix of card apertures formed therein, each card aperture is sized for positioning one of said pipette tips there through to further register with an aperture of a matrix of tray apertures of a dispensing tray, said receiving card having an upper surface spaced from a lower surface, said card apertures each being shaped and sized to receive a pipette tip to hold said pipette tip with a portion extending a spacing distance away from said upper surface of said receiving card, said receiving card having a length and a width and said receiving card having two opposite card edges extending along said length of said receiving card in substantial alignment; and a transfer member for engaging and maintaining said pipette tips in a stable position relative to said receiving card, said transfer member being configured with no structure for attaching said transfer member to said receiving card, said transfer member being a plate with an upper surface and with an undersurface, said undersurface having a plurality of projections extending from said undersurface, each of which projections being positioned and sized to extend away from said undersurface a distance selected so that upon registry of said projection with said first end of said pipette tips, said projections engaging said pipette tips to inhibit lateral movement of said transfer member relative to said pipette tips positioned in said matrix of card apertures, said preselected distance between the tip of the finger and the first knuckle back from the tip of said finger, said plate having a length and a width selected comparable to the length and width of said receiving card and said plate having two opposite plate edges extending along said length of said plate in substantial alignment with each other for positioning relative to said card edges, said spacing distance being elected to position said receiving card and said plate and in turn said card edges and said plate edges relative to each other at said spacing distance for simultaneous engagement by the thumb and a finger of one hand of a user to retain said receiving card and said plate in alignment and relative to each other while transferring said receiving card with said pipette tips from a first location to alignment with and positioning in said matrix of tray apertures of said dispensing tray.

14. A method for transferring a plurality of pipette tips from a container to a holding tray, comprising the steps of:

providing a container for holding a plurality of receiving plates in a stack, each of said receiving plates being configured to hold a plurality of pipette tips in an array;

providing a stack of receiving plates unconnected to and unconnectable to a transfer member, each receiving plate consisting essentially of a plurality of apertures formed therein, each aperture is sized to receive a pipette tip therethrough, each receiving plate having a plurality of pipette tips each disposed in one of said plurality of apertures, each of said pipette tips having a first end and a second end spaced from said first end, said first end having an opening extending into said pipette tip, said stack of receiving plates including a first receiving plate with a first plurality of pipette tips disposed in a first pattern thereon and a second receiving plate with a second plurality of pipette tips disposed in a second pattern thereon, said second pattern being arranged to position said second end of said pipette tips in said second pattern to nest into the openings of said first plurality of pipette tips, positioning said stack of receiving plates with pipette tips into said container;

providing said transfer member that is shaped to fit within said container, said transfer member configured to not be connectable to any receiving plate of said stack of receiving plates, said transfer member having an upper surface and a lower surface and a plurality of projections arranged in said first pattern, each projection of said plurality of projections extending from said lower surface a preselected distance to effect stable engagement with a corresponding first end of a pipette tip when said projection is received into said first opening of said pipette tip;

providing a holding tray positioned on a support surface, said holding tray having an upper wall spaced from said support surface and a plurality of apertures extending through said upper wall and arranged in said first pattern;

grasping said transfer member with the thumb and forefinger of a user and positioning said transfer member over said container;

aligning the projections of said transfer member with the openings of said second plurality of pipette tips;

lowering said transfer member into said container until said projections extend into and engage with said second plurality of pipette tips;

grasping both said transfer member and said second receiving plate with the thumb and a finger of said user and holding them together while removing said transfer member and said second receiving plate with said second plurality of pipette tips from said container;

positioning said transfer member, said second receiving plate and said second plurality of pipette tips over said holding tray;

aligning said second plurality of pipette tips with said plurality of apertures of said holding tray;

lowering said transfer member, said second receiving plate and said second plurality of pipette tips toward said holding tray until said second plurality of pipette tips has been inserted into and engaged with corresponding apertures of said holding tray;

releasing said thumb and forefinger from said transfer member and said second receiving plate; and removing said transfer member from said second plurality of pipette tips.

* * * * *